US009515407B2

(12) United States Patent
Ohyama

(10) Patent No.: US 9,515,407 B2
(45) Date of Patent: Dec. 6, 2016

(54) ELECTRICAL CONNECTOR WITH PRESS-FITTED RECTANGULAR WIRE TERMINAL

(71) Applicant: Yazaki Corporation, Tokyo (JP)

(72) Inventor: Kouichi Ohyama, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/799,794

(22) Filed: Jul. 15, 2015

(65) Prior Publication Data

US 2016/0020544 A1 Jan. 21, 2016

(30) Foreign Application Priority Data

Jul. 16, 2014 (JP) ..... 2014-145877

(51) Int. Cl.
*H01R 13/42* (2006.01)
*H01R 13/41* (2006.01)

(52) U.S. Cl.
CPC ..... *H01R 13/41* (2013.01)

(58) Field of Classification Search
CPC ..... H01R 12/585; H01R 13/41; H01R 13/213; H05K 3/308
USPC ..... 439/751, 733.1
See application file for complete search history.

(56) References Cited

U.S. PATENT DOCUMENTS 2,995,617 A * 8/1961 Just ..... H01R 9/16 174/153 R
3,328,749 A * 6/1967 Kukla ..... H01R 9/16 439/389
3,444,504 A * 5/1969 Erline ..... H01R 13/28 439/248
3,675,185 A * 7/1972 Ruehlemann ..... H01R 13/748 439/564
5,692,928 A * 12/1997 Nelson ..... H01R 13/41 439/733.1
6,152,781 A * 11/2000 Huang ..... H01R 12/727 439/686
6,152,782 A * 11/2000 Volkert ..... H01R 13/41 439/733.1
6,328,576 B1 * 12/2001 Takahashi ..... H01R 13/41 439/733.1

(Continued)

FOREIGN PATENT DOCUMENTS

JP 2000-215959 A 8/2000
JP 2000-243495 A 9/2000

*Primary Examiner* — Tulsidas C Patel
*Assistant Examiner* — Peter G Leigh
(74) *Attorney, Agent, or Firm* — Sughrue Mion, PLLC

(57) ABSTRACT

When a front end part of an upper surface of a first upper press-fit portion is brought into contact with a boundary part between a first terminal press-fit guiding groove and a second terminal press-fit guiding groove, the position of a rectangular wire terminal is thereafter accurately corrected along the first terminal press-fit guiding groove. That is, a distance from a lower surface of a terminal main body to the upper surface of the first upper press-fit portion coincides with a height from a lower surface of a cavity main part to the upper end of the first terminal press-fit guiding groove. As a result, the first press-fit portion reaches the first terminal press-fit guiding groove and thereafter, the rectangular wire terminal is further press-fitted, and forcibly pressed against the lower surface of the cavity main part.

3 Claims, 11 Drawing Sheets

(56) References Cited

U.S. PATENT DOCUMENTS

| | | | | |
|---|---|---|---|---|
| 6,764,357 | B2 * | 7/2004 | Wu | H01R 43/20 439/637 |
| 7,249,981 | B2 * | 7/2007 | Chen | H01R 12/585 439/751 |
| 7,361,031 | B2 * | 4/2008 | Matsumura | H01R 12/585 29/845 |
| 7,377,823 | B2 * | 5/2008 | Chen | H01R 12/585 439/751 |
| 7,604,517 | B2 * | 10/2009 | Hsieh | H01R 13/41 439/733.1 |
| 7,722,413 | B2 * | 5/2010 | Tonosaki | H01R 13/41 439/733.1 |
| 7,988,500 | B2 * | 8/2011 | Furukawa | H01R 13/41 439/66 |
| 8,210,856 | B2 * | 7/2012 | Suzuki | H01R 12/585 439/733.1 |
| 8,444,444 | B2 * | 5/2013 | Kitajima | H01R 13/521 439/751 |
| 8,992,235 | B2 * | 3/2015 | Kataoka | H01R 12/585 439/751 |
| 9,172,166 | B2 * | 10/2015 | Kida | H01R 13/41 |
| 9,214,760 | B2 * | 12/2015 | Endo | H01R 13/58 |
| 9,265,150 | B2 * | 2/2016 | Fox | H05K 1/18 |
| 2004/0219841 | A1 * | 11/2004 | Yamashita | H01R 13/41 439/733.1 |
| 2004/0242082 | A1 * | 12/2004 | Tsuchiya | H01R 12/585 439/751 |
| 2009/0117755 | A1 * | 5/2009 | Tonosaki | H01R 13/41 439/55 |
| 2009/0221192 | A1 * | 9/2009 | Fedder | H01R 12/585 439/751 |

* cited by examiner

ELECTRICAL CONNECTOR WITH PRESS-FITTED RECTANGULAR WIRE TERMINAL

CROSS-REFERENCE TO RELATED APPLICATION(S)

The present application claims priority to and incorporates by reference the entire contents of Japanese Patent Application No. 2014-145877 filed in Japan on Jul. 16, 2014.

BACKGROUND OF THE INVENTION

1. Field of the Invention

The present invention relates to a connector used for electrical connection between various devices mounted on an automobile or the like, and more particularly to a connector provided with a connector housing and a rectangular wire terminal to be press-fitted into the connector housing.

2. Description of the Related Art

Conventionally, there has been developed various kinds of connectors in each of which a rectangular wire terminal (circuit board terminal) composed of a metallic rectangular wire is inserted and held in a cavity (terminal holding hole) formed in a connector housing of the connector.

For example, there has been developed a technique that prevents rattling of a terminal metal fitting (see Japanese Patent Application Laid-open No. 2000-215959). In the technique, a through hole into which a tab of the terminal metal fitting is inserted has holding projections formed for pressing both sides of the tab at positions deviated from each other. The tab sandwiched between the holding projections prevents the movement of the terminal metal fitting with respect to a socket body.

Furthermore, there has been a terminal structure using a rectangular wire (rectangular wire terminal), the terminal structure being capable of preventing rattling of the rectangular wire terminal in the vertical direction and maintaining holding force when the rectangular wire terminal is press-fitted into a terminal holding hole of a connector housing (see Japanese Patent Application Laid-open No. 2000-243495, for example). To be more specific, the terminal structure is provided with two sets of a pair of first lock projections formed, in an intermediate portion of a circuit board terminal (rectangular wire terminal), on the laterally opposite sides of a locking part to be held in a terminal holding hole so as to be press-fitted into the terminal holding hole while being pressed onto respective opposite side walls. The terminal structure is provided with a second lock projection having a longitudinally elongated oval cross-section, the second lock projection being formed between the two sets of the first lock projections so as to be press-fitted into the terminal holding hole while being pressed onto a top wall or a bottom wall in the vertical direction.

FIGS. 12A and 12B each illustrate a connector in a state in which a rectangular wire terminal 150 is press-fitted into a cavity 130 of a connector housing 120. FIG. 12B is an enlarged view of a partial area B1 in FIG. 12A. Generally, a clearance between the cavity 130 and the rectangular wire terminal 150 is required as illustrated in FIG. 12B. Here, FIG. 12B illustrates a clearance Δ1 between a cavity upper face 131 and a terminal upper face 151, and a clearance Δ2 between a cavity side face 132 and a terminal side face 152. To consider a case where there is no clearance, when the rectangular wire terminal 150 is press-fitted into the cavity 130, the cavity 130 and the rectangular wire terminal 150 are always brought into contact with each other thus extremely increasing contact pressure therebetween. As a result, metal burrs are generated from the rectangular wire terminal 150, which may cause defective continuity. On the other hand, there has been the problem that the clearance causes positional accuracy to lower. In the technique disclosed in Japanese Patent Application Laid-open No. 2000-215959, the terminal structure is not a press-fit structure and the projecting portions are formed on a resin-made housing side, that is, a cavity side. Hence, the terminal is always brought into contact with the projecting portions when the terminal is inserted into the cavity. As a result, there has been the problem that burrs are easily generated, and another technique has been required. In the technique disclosed in Japanese Patent Application Laid-open No. 2000-243495, the press-fit structure is provided in the lateral direction and hence, there has been the problem that burrs are easily generated when the rectangular wire terminal is inserted into the cavity, and another technique has been required.

SUMMARY OF THE INVENTION

The present invention has been made under such circumstances, and it is an object of the present invention to provide a technique that solves the above-mentioned problems.

According to one aspect of the present invention, a connector includes a connector housing; and a rectangular wire terminal configured to be press-fitted into and held in a cavity of the connector housing, wherein the rectangular wire terminal includes a press-fit portion that is formed in a projecting manner on each of two surfaces facing each other perpendicular to a terminal insertion direction into the connector housing and press-fitted into the cavity, and the cavity has guide grooves each of which guides the press-fit portion by a certain length toward a frontward direction from an opening located on a rear side in the terminal insertion direction.

Further, in the connector, the press-fit portion may be housed in the guide groove with press-fitted manner in a state in which the press-fit of the rectangular wire terminal is completed.

Further, in the connector, the press-fit portion may include a first press-fit portion and a second press-fit portion that are located side by side on a front side and on a rear side, respectively, in the insertion direction, the guide groove may include a first guide groove in which the first press-fit portion is housed and a second guide groove in which the second press-fit portion is housed, in a state in which the press-fit of the rectangular wire terminal is completed, and a width of the first guide groove may be smaller than that of the second guide groove, and set substantially equal to a width of the first press-fit portion.

Further, in the connector, the second press-fit portion may be formed in a further projected manner than the first press-fit portion, and the second guide groove may be formed more deeply than the first guide groove.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a mode for carrying out the invention (hereinafter, referred to as "embodiment") is explained with reference to the drawings.

Figure 1:
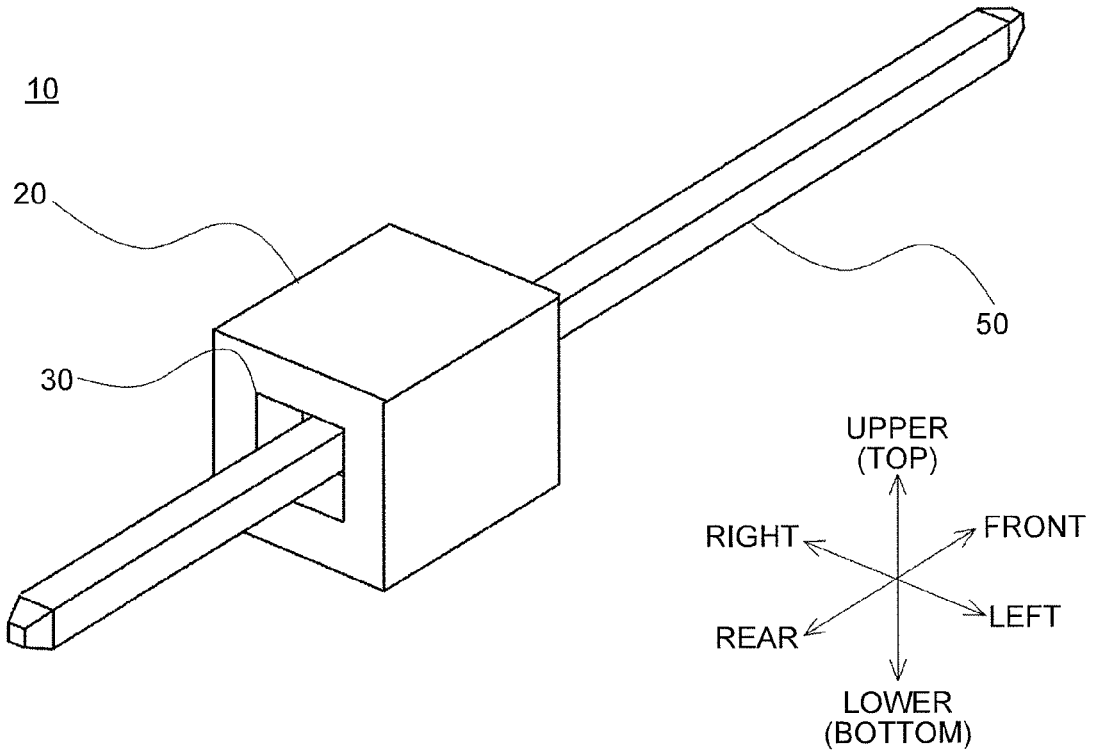
FIG. 1 is a perspective view illustrating a schematic structure of a connector according to an embodiment.

FIG. 1 is a perspective view illustrating a schematic structure of a connector 10 according to the embodiment. Here, the structure of a part into which a rectangular wire terminal 50 is inserted is discriminatively illustrated.

As illustrated in FIG. 1, the connector 10 is provided with a housing 20 and the rectangular wire terminal 50. The housing 20 forms therein a cavity 30 having a substantially rectangular shape as viewed in a cross-sectional view, the cavity 30 being a terminal holding hole. The rectangular wire terminal 50 is press-fitted into and held in the cavity 30.

Figure 2:
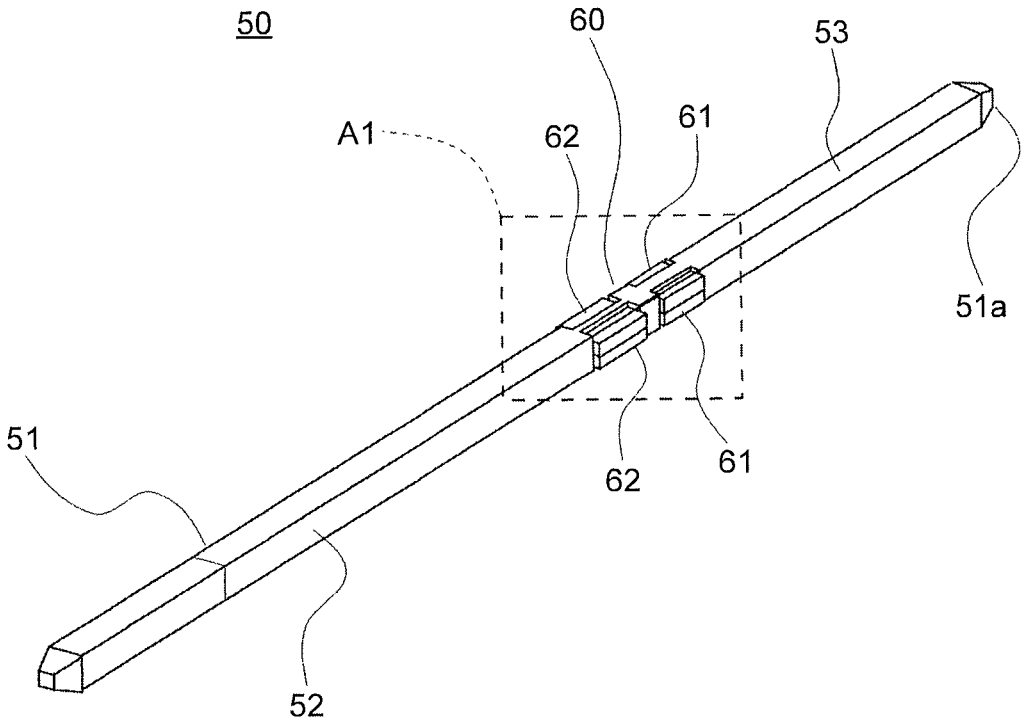
FIG. 2 is a perspective view of a rectangular wire terminal according to the embodiment.
Figure 3:
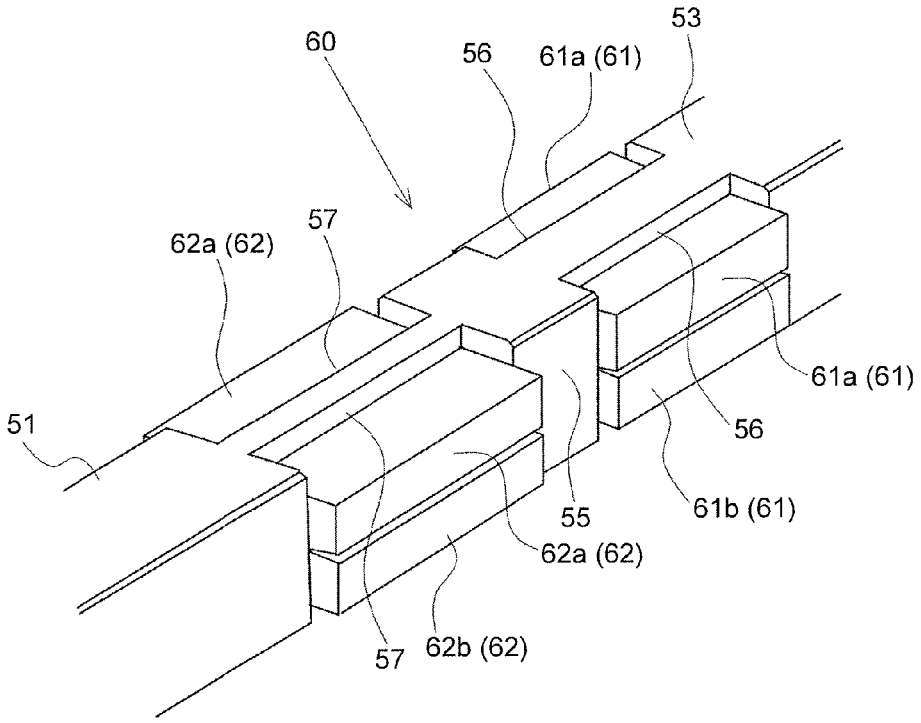
FIG. 3 is an enlarged perspective view of the region where the press-fit portion is formed on the rectangular wire terminal according to the embodiment.
Figure 4:
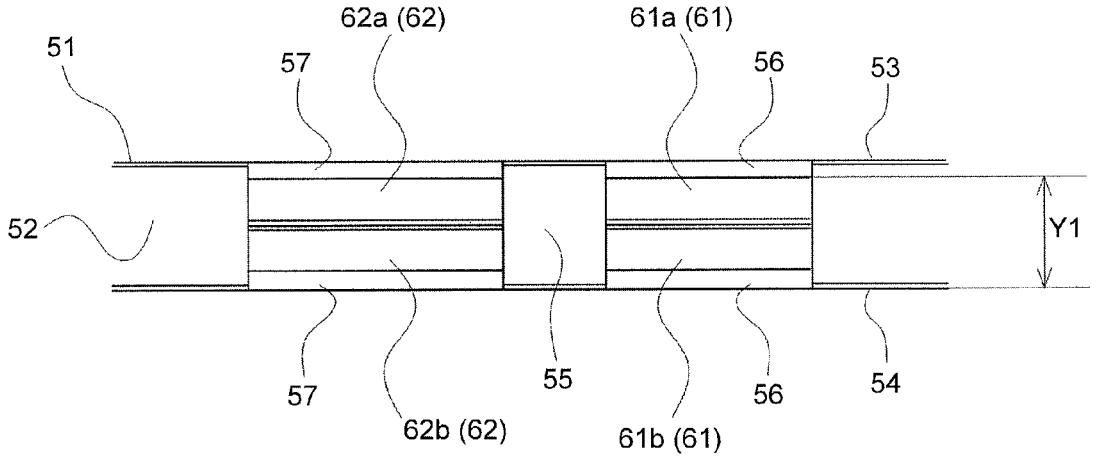
FIG. 4 is an enlarged side view of the press-fit portion on the rectangular wire terminal according to the embodiment.

FIG. 2 is a perspective view of the rectangular wire terminal 50. Furthermore, FIG. 3 is an enlarged perspective view of the region where a press-fit portion 60 is formed on the rectangular wire terminal 50; that is, an enlarged view of a partial region A1 in FIG. 2. FIG. 4 is an enlarged side view of the press-fit portion 60 in the rectangular wire terminal 50.

The press-fit portion 60 includes first press-fit portions 61 arranged on the front side in the terminal insertion direction, and second press-fit portions 62 arranged on the rear side in the terminal insertion direction. Each of the first press-fit portions 61 and each of the second press-fit portions 62 are arranged side by side in the longitudinal direction with a certain distance (the width of a surface 55) therebetween while being formed in a projecting shape from a side surface 52 in the lateral direction (in the direction perpendicular to the terminal insertion direction). The respective lengths of the first press-fit portion 61 and the second press-fit portion 62 in the longitudinal direction are substantially equal to each other. Furthermore, the projection amount of the first press-fit portion 61 is slightly smaller than the projection amount of the second press-fit portion 62. That is, the width of the first press-fit portion 61 is slightly smaller than the width of the second press-fit portion 62.

The first press-fit portions 61 are formed on respective both sides of the rectangular wire terminal 50 in left-and-right symmetry. Furthermore, each of the first press-fit portions 61 is formed in two stages in up-and-down symmetry. Here, the first press-fit portion 61 includes a first upper press-fit portion 61*a* located on the upper side thereof and a first lower press-fit portion 61*b* located on the lower side thereof. A vertically intermediate region (that is, a boundary region) between the first upper press-fit portion 61*a* and the first lower press-fit portion 61*b* is formed in a groove shape having substantially V-shape. However, the groove shape is not limited to the substantially V-shape, and another shape such as a U-shape may be applicable.

The upper surface of the first upper press-fit portion 61*a* is formed as a surface that is parallel to an upper surface 53 of a terminal main body 51 and located at a position lower than the upper surface 53 by a certain distance. Furthermore, the lower surface of the first lower press-fit portion 61*b* is formed as a surface that is parallel to a lower surface 54 of the terminal main body 51 and located at a position higher than the lower surface 54 by a certain distance.

In the same manner as above, the second press-fit portions 62 are formed on respective both sides of the rectangular wire terminal 50 in left-and-right symmetry. Furthermore, the second press-fit portion 62 is formed in two stages in up-and-down symmetry. Here, the second press-fit portion 62 includes a second upper press-fit portion 62*a* located on the upper side thereof and a second lower press-fit portion 62*b* located on the lower side thereof. A vertically intermediate region (that is, a boundary region) between the second upper press-fit portion 62*a* and the second lower press-fit portion 62*b* is formed in a groove shape having substantially V-shape. However, the groove shape is not limited to the substantially V-shape, and another shape such as a U-shape may be applicable.

Furthermore, the upper surface of the second upper press-fit portion 62*a* is formed as a surface that is parallel to the upper surface 53 of the terminal main body 51 and located at a position lower than the upper surface 53 by a certain distance. In addition, the lower surface of the second lower press-fit portion 62*b* is formed as a surface that is parallel to the lower surface 54 of the terminal main body 51 and located at a position higher than the lower surface 54 by a certain distance.

As illustrated in the drawings, the upper surface of the second upper press-fit portion 62*a* is formed so as to be flush with the upper surface of the first upper press-fit portion 61*a*.

In the region in which the press-fit portion 60 is formed, recessed portions 56 are formed above and below the first press-fit portion 61, respectively, so that the upper surface and the lower surface of the first press-fit portion 61, that is, the upper surface of the first upper press-fit portion 61*a* and the lower surface of the first lower press-fit portion 61*b* are exposed. In the same manner as above, recessed portions 57 are formed above and below the second press-fit portion 62, respectively, so that the upper surface and the lower surface of the second press-fit portion 62, that is, the upper surface of the second upper press-fit portion 62*a* and the lower surface of the second lower press-fit portion 62*b* are exposed.

Figure 5A:
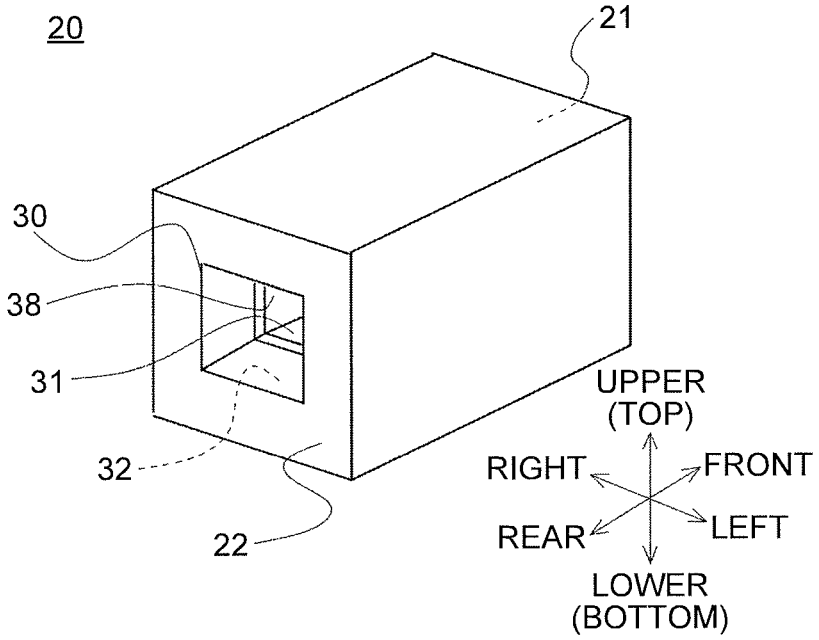
FIGS. 5A and 5B are views each illustrating a housing according to the embodiment.
Figure 5B:
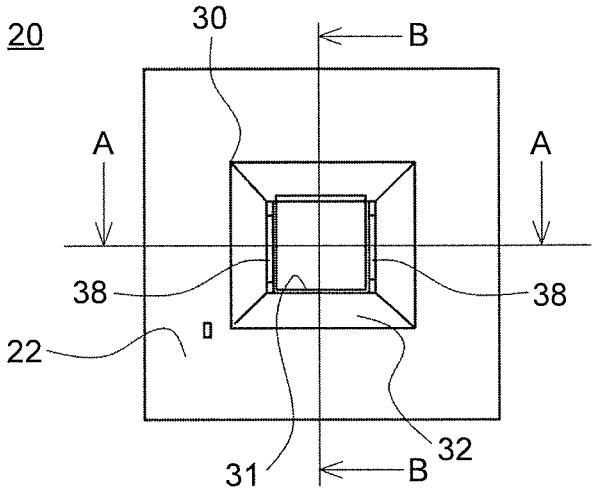
Figure 6:
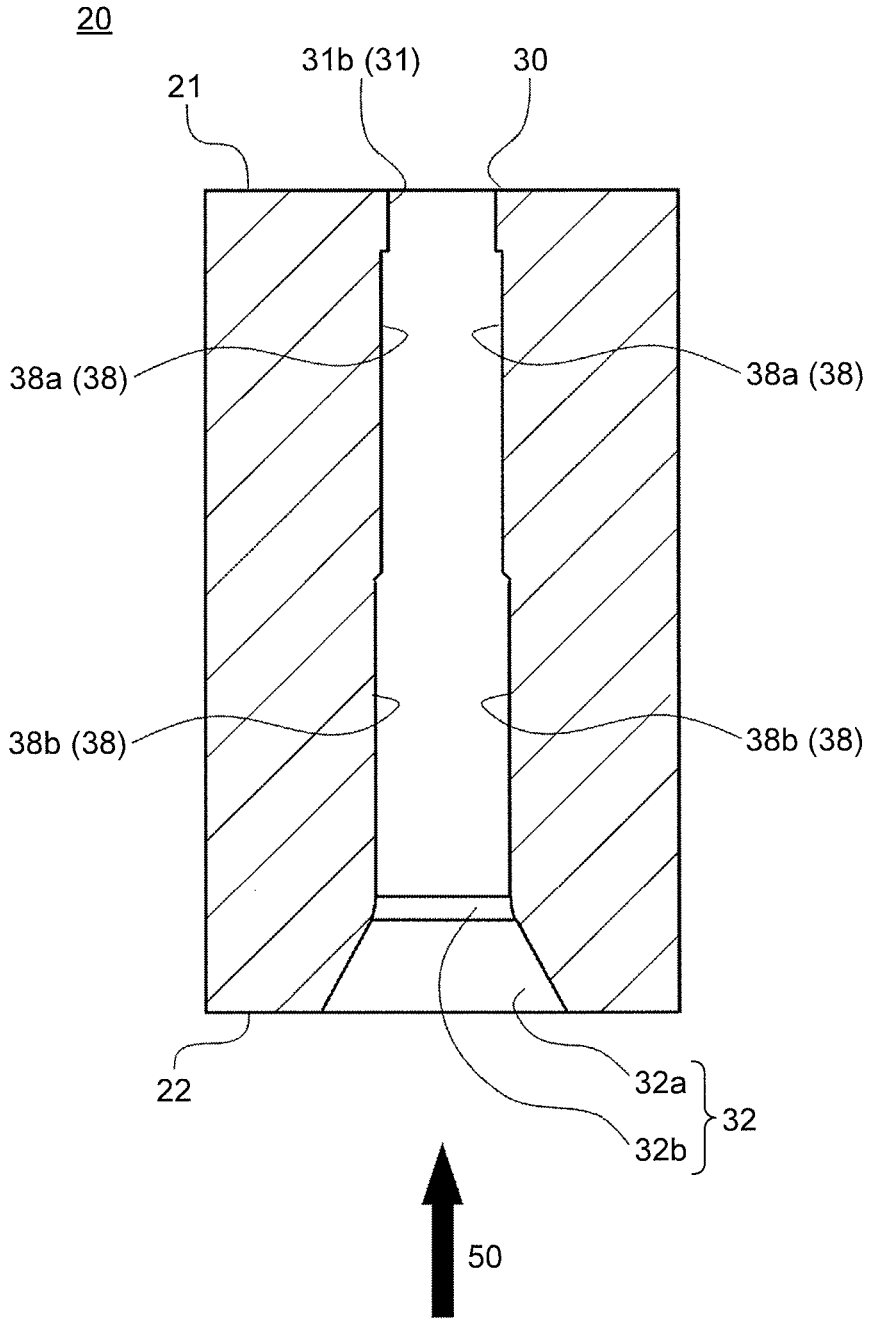
FIG. 6 is a cross-sectional view (cross-sectional view taken along line A-A in FIG. 5B) of the housing according to the embodiment.
Figure 7A:
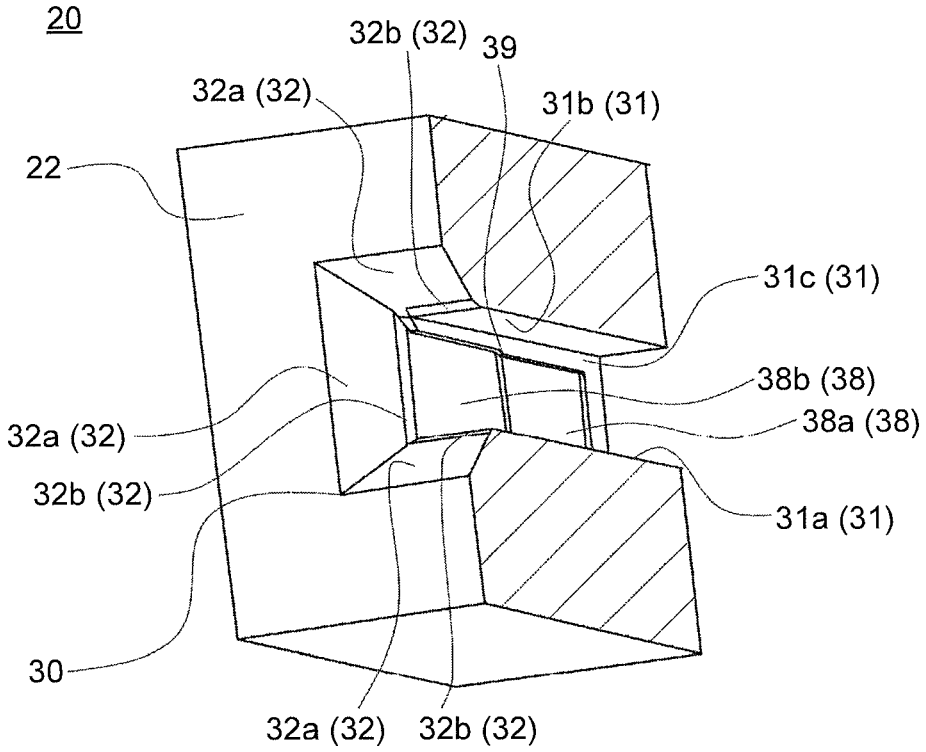
FIGS. 7A and 7B are longitudinal sectional views (longitudinal sectional views each taken along line B-B in FIG. 5B) of the housing according to the embodiment.
Figure 7B:
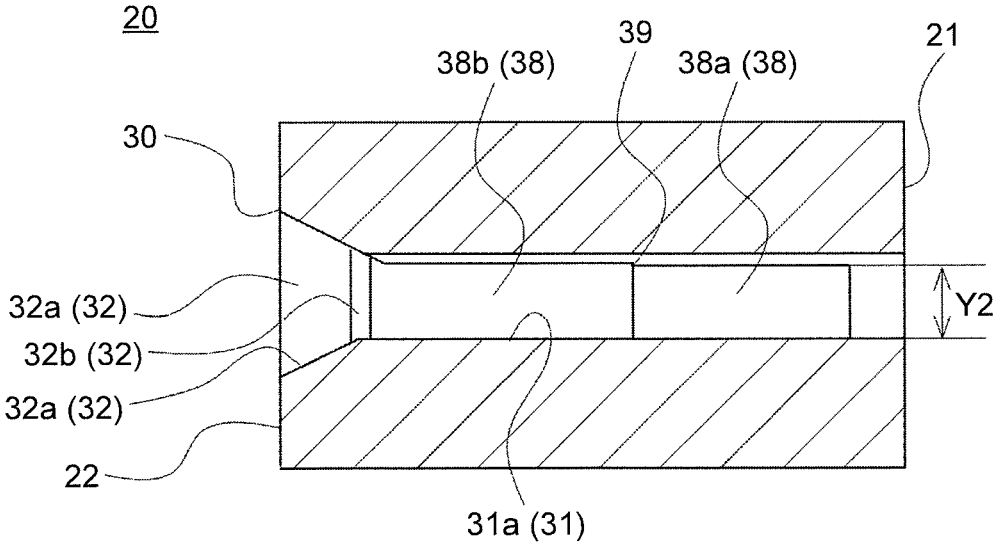

FIGS. 5A and 5B are views each illustrating the housing 20, FIG. 5A is a perspective view of the housing 20, and FIG. 5B is a rear view illustrating the rear surface 22 side of the housing 20. FIG. 6 is a cross-sectional view (a cross-sectional view taken along line A-A in FIG. 5B) of the housing 20. FIGS. 7A and 7B are longitudinal sectional views (longitudinal sectional views each taken along line B-B in FIG. 5B) of the housing 20, FIG. 7A is a perspective view, and FIG. 7B is a cross-section side view of the housing 20 cut away along the line B-B.

The cavity 30 includes a cavity main part 31 extending through a front surface 21 and a rear surface 22 of the housing 20, and an insertion guide part 32 including inclined surfaces located on the rear surface 22 side of the housing 20 and extending toward the opening side thereof in such a manner that the area of the opening gradually increases. The rectangular wire terminal 50 (terminal end 51*a*) is inserted from the insertion guide part 32. The insertion guide part 32 is constituted of a first guide part 32*a* located on the opening side thereof, and second guide part 32*b* located on the inner side (cavity main part 31 side) thereof.

Each of both side surfaces of the cavity main part 31 forms therein a terminal press-fit guiding groove 38 having a certain length from the insertion guide part 32 side thereof to the inner side thereof in the insertion direction, with a certain depth.

The terminal press-fit guiding groove 38 includes a first terminal press-fit guiding groove 38*a* located on the inner side thereof (front surface 21 side) in the insertion direction, and a second terminal press-fit guiding groove 38*b* located on the rear side thereof (rear surface 22 side) in the insertion direction.

The first press-fit portion 61 is housed in the first terminal press-fit guiding groove 38*a* in a state in which the first press-fit portion 61 is press-fitted when the press-fit of the rectangular wire terminal 50 is completed. The second press-fit portion 62 is housed in the second terminal press-fit guiding groove 38*b* in a state in which the second press-fit portion 62 is press-fitted when the press-fit of the rectangular wire terminal 50 is completed.

As illustrated in the cross-sectional view in FIG. 6, at the position where the terminal press-fit guiding groove 38 is formed, the first terminal press-fit guiding groove 38*a* and the second terminal press-fit guiding groove 38*b* have depths corresponding to the respective projection amounts of the first press-fit portion 61 and the second press-fit portion 62. That is, the depth of the first terminal press-fit guiding groove 38*a* is smaller than that of the second terminal press-fit guiding groove 38*b*. The respective lower ends of the first terminal press-fit guiding groove 38*a* and the second terminal press-fit guiding groove 38*b* are formed so as to be substantially flush with the lower surface of the cavity main part 31.

The upper end of the first terminal press-fit guiding groove 38*a*, that is, the height of the first terminal press-fit guiding groove 38*a*, is set to be flush with the upper surface of the first upper press-fit portion 61*a* when the first press-fit portion 61 is housed in the first terminal press-fit guiding groove 38*a*. On the other hand, the upper end position of the second terminal press-fit guiding groove 38*b*, that is, the height of the second terminal press-fit guiding groove 38*b*, is set slightly higher than the height of the first terminal press-fit guiding groove 38*a*. In other words, the height of the second terminal press-fit guiding groove 38*b* is slightly higher than the heights of the first press-fit portion 61 and the second press-fit portion 62.

Figure 8:
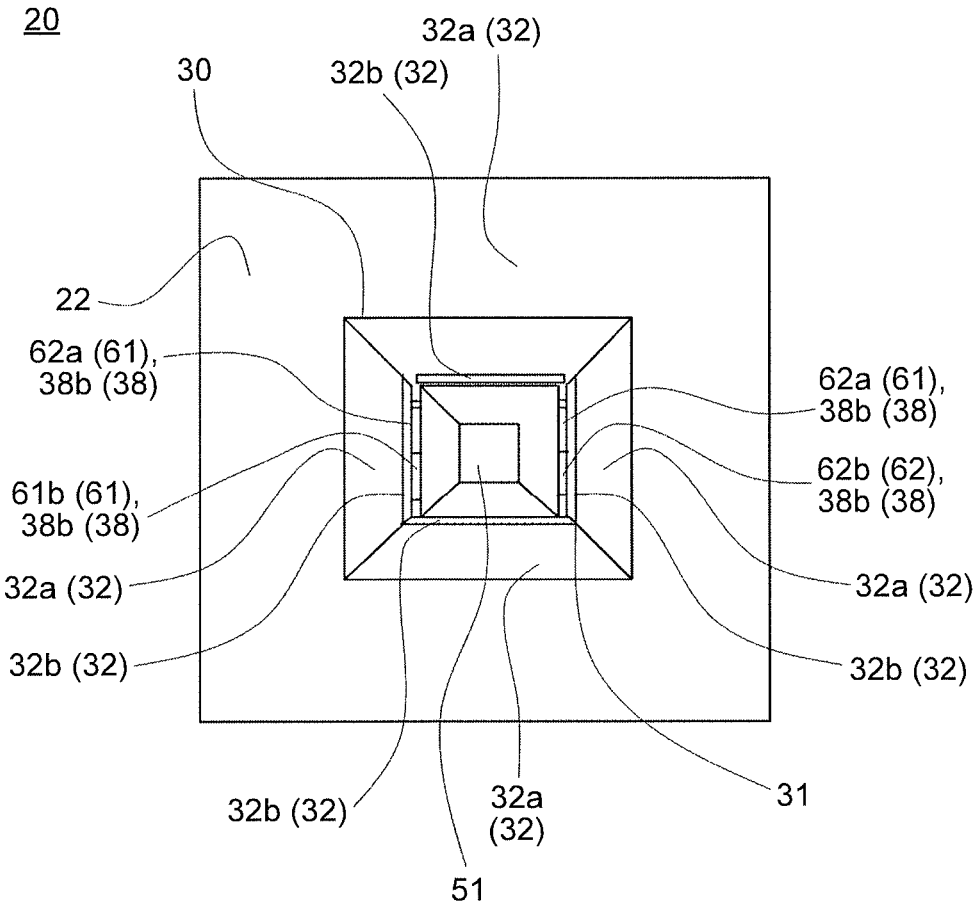
FIG. 8 is a rear view of the housing in a state in which the rectangular wire terminal is press-fitted into the cavity of the housing according to the embodiment.
Figure 9A:
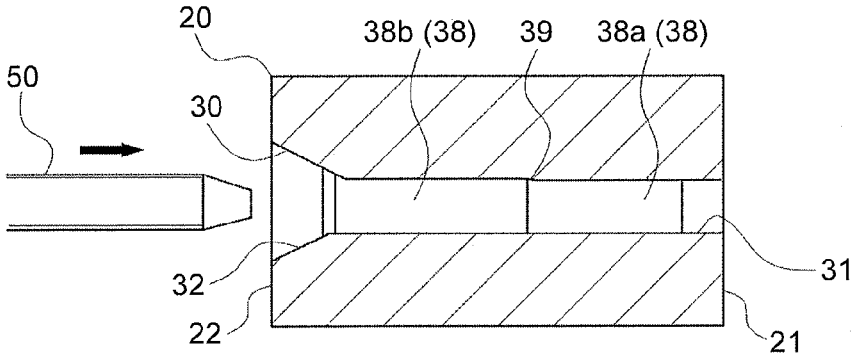
FIGS. 9A, 9B, and 9C are views each illustrating a process of inserting the rectangular wire terminal into the cavity of the housing according to the embodiment.
Figure 9B:
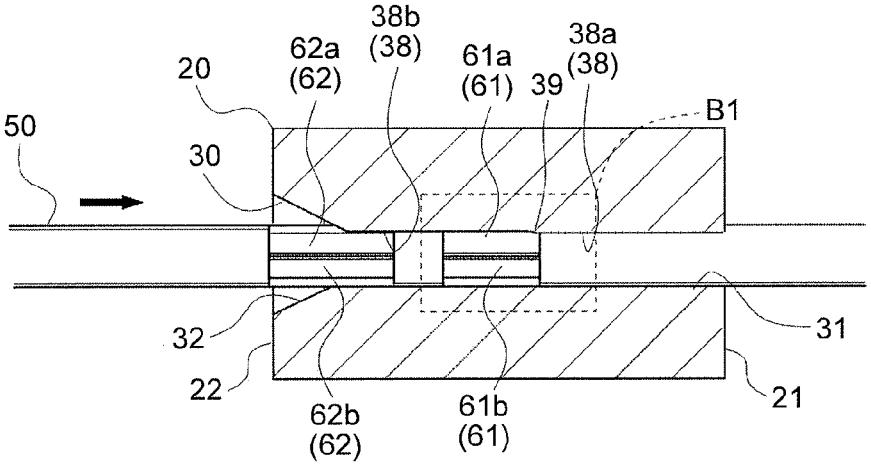
Figure 9C:
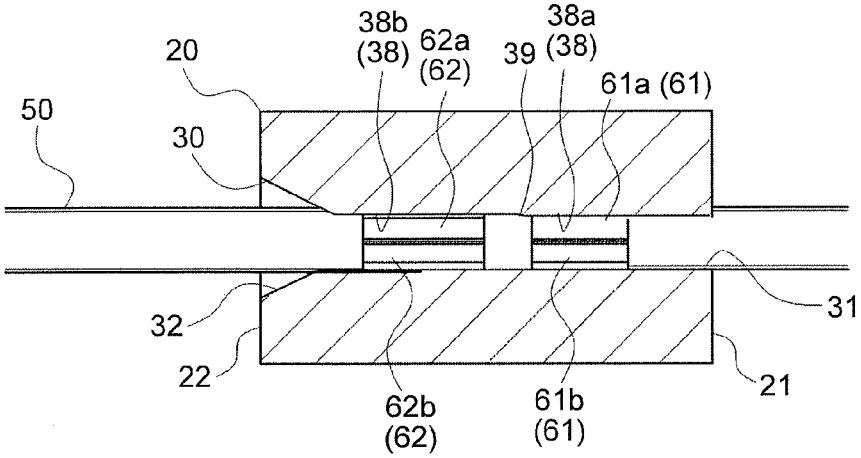
Figure 10:
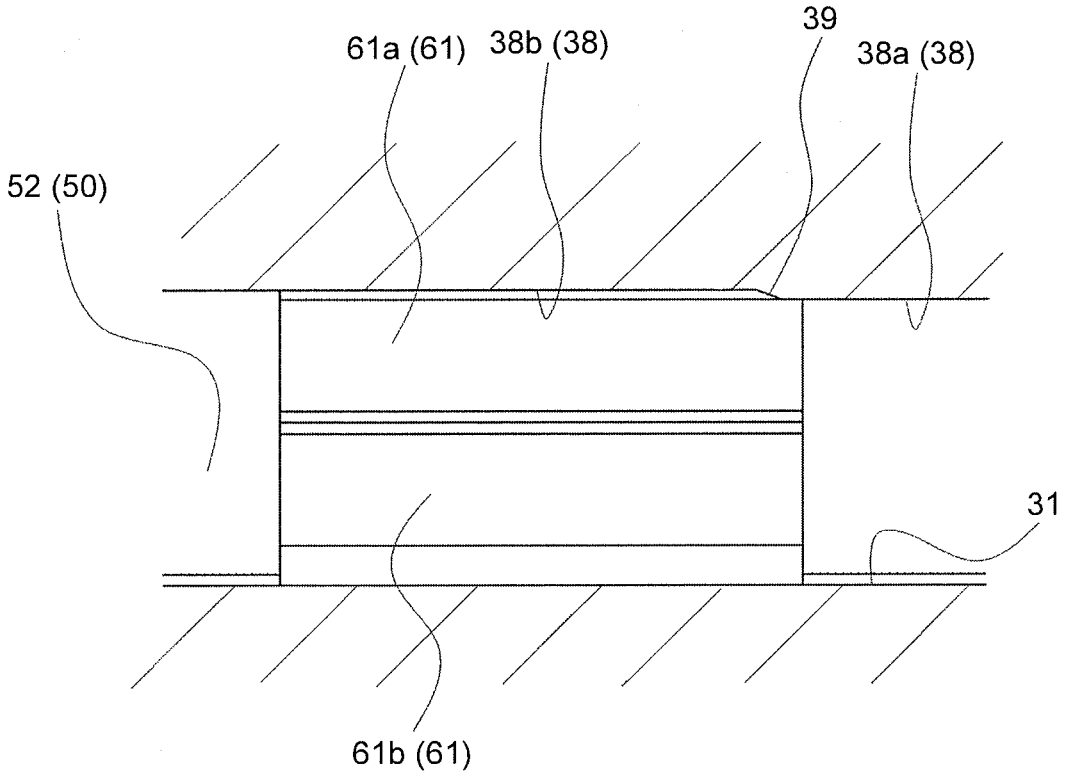
FIG. 10 is an enlarged longitudinal sectional view illustrating the press-fit portion in the middle of the process of inserting the rectangular wire terminal into the cavity according to the embodiment.
Figure 11:
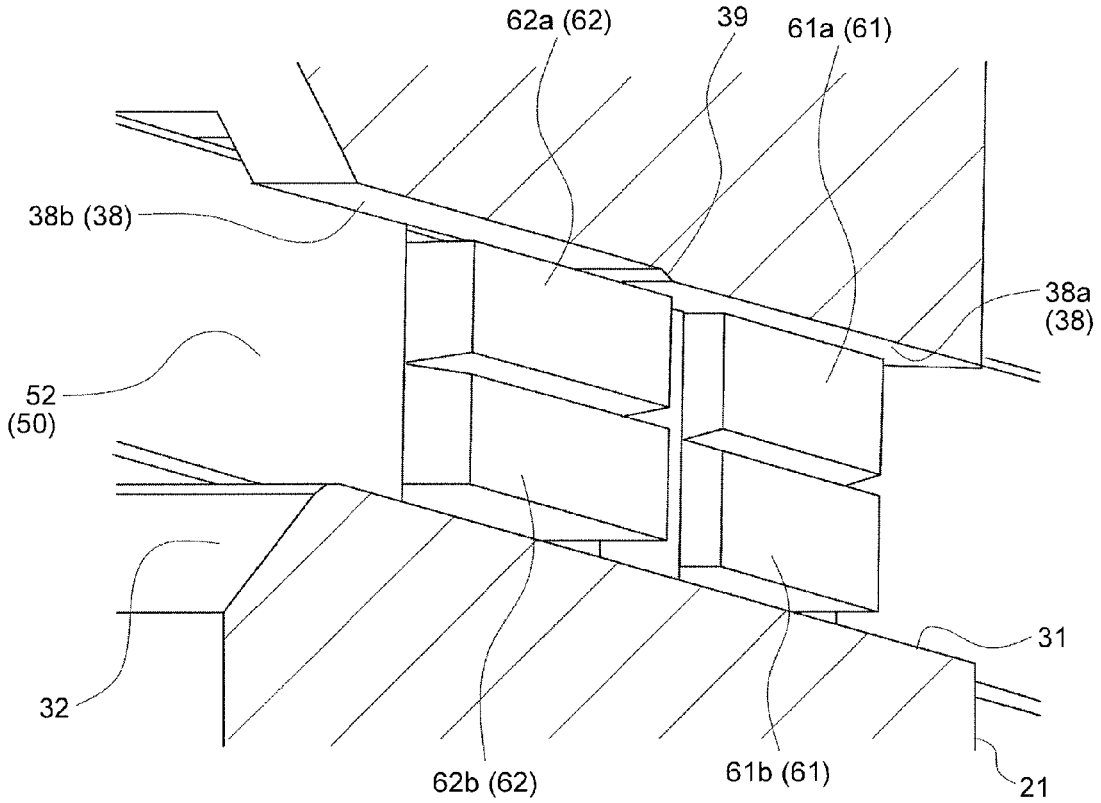
FIG. 11 is an enlarged view of the press-fit portion cut away in the longitudinal direction, as viewed from the oblique direction, according to the embodiment.
Figure 12A:
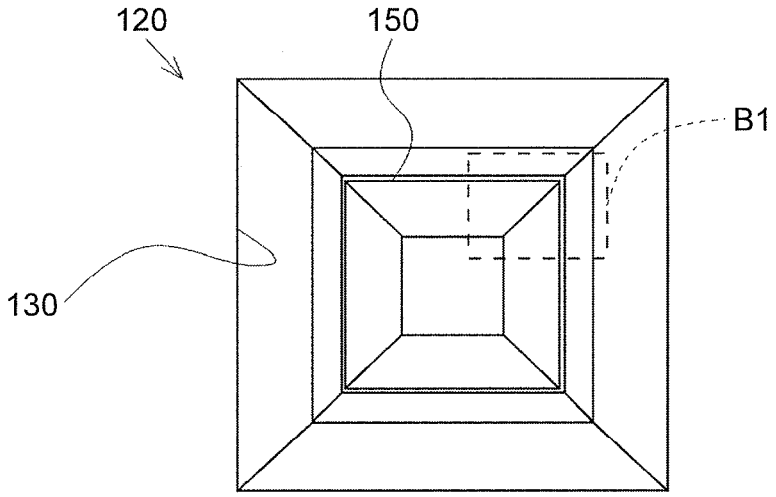
FIGS. 12A and 12B are views illustrating the connector in a state in which the rectangular wire terminal is inserted into the cavity of the connector housing according to the Related Art.
Figure 12B:
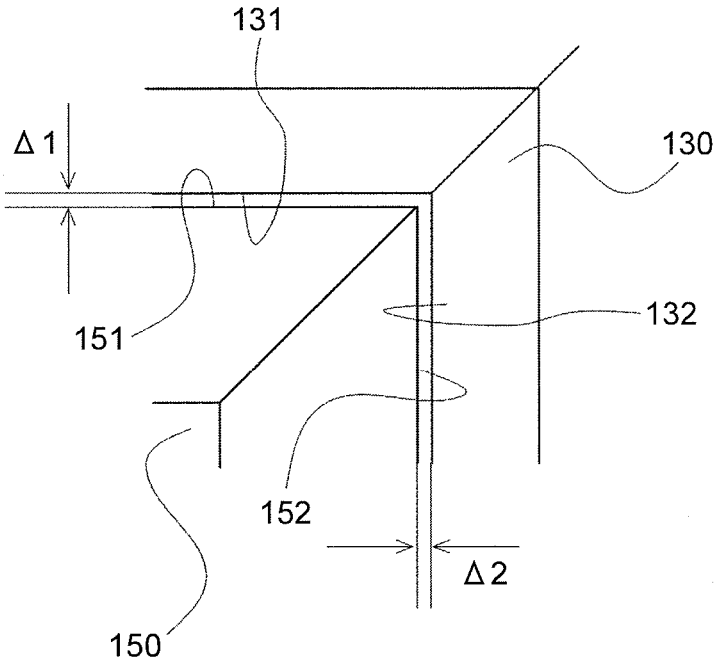

In the connector 10 constituted in such a manner as described above, an explanation is made with respect to the processes of press-fitting the rectangular wire terminal 50 into the cavity 30 of the housing 20. FIG. 8 is a view (rear view) of the rear surface 22 side of the housing 20 in a state in which the rectangular wire terminal 50 is press-fitted into the cavity 30 of the housing 20. FIGS. 9A, 9B, and 9C are views each illustrating a process of inserting the rectangular wire terminal 50 into the cavity 30 of the housing 20. FIG. 9A illustrates a longitudinal sectional view in a state before the rectangular wire terminal 50 is inserted into the cavity 30, FIG. 9B illustrates a longitudinal sectional view in a state in the middle of the insertion of the rectangular wire terminal 50, and FIG. 9C illustrates a longitudinal sectional view in a state in which the insertion of the rectangular wire terminal 50 is completed. FIG. 10 is an enlarged longitudinal sectional view illustrating the press-fit portion 60 in the middle of the process of inserting the rectangular wire terminal 50 into the cavity 30, and is an enlarged view of a region B1 indicated by a broken line in FIG. 9B. FIG. 11 is a view (cross-sectional perspective view) illustrating the press-fit portion 60 in FIG. 10, as viewed from the oblique direction.

As illustrated in FIG. 9A, the rectangular wire terminal 50 is inserted from the insertion guide part 32 side of the cavity 30. Thereafter, as illustrated in FIGS. 9B, 10, and 11, the rectangular wire terminal 50 is further inserted into the inner side of the cavity 30. The first press-fit portion 61 first passes through the second terminal press-fit guiding groove 38*b*. The second terminal press-fit guiding groove 38*b* has a shape corresponding to the second press-fit portion 62, and is formed to be slightly larger than the first press-fit portion 61. Therefore, while its position being corrected to some extent in this process, the rectangular wire terminal 50 is capable of being relatively smoothly inserted into the second terminal press-fit guiding groove 38*b*.

Furthermore, when the front end of the first press-fit portion 61 reaches the position of the first terminal press-fit guiding groove 38*a*, that is, when the front end part of the upper surface of the first upper press-fit portion 61*a* is brought into contact with a boundary part 39 between the first terminal press-fit guiding groove 38*a* and the second terminal press-fit guiding groove 38*b*, the position of the rectangular wire terminal 50 is thereafter accurately corrected along the first terminal press-fit guiding groove 38*a*. That is, a distance Y1 (see FIG. 4) from a lower surface 54 of the terminal main body 51 to the upper surface of the first upper press-fit portion 61*a* coincides with a height Y2 (see FIG. 7B) from a lower surface 31*a* of the cavity main part 31 to the upper end of the first terminal press-fit guiding groove 38*a*. As a result, the first press-fit portion 61 reaches the first terminal press-fit guiding groove 38*a* and thereafter, the rectangular wire terminal 50 is further press-fitted, and forcibly pressed against the lower surface 31*a* of the cavity main part 31. Therefore, the rectangular wire terminal 50 located in the cavity 30 is not loose in the vertical direction.

In the present embodiment, the rectangular wire terminal 50 has projecting portions (the press-fit portion 60) formed thereon, and a sufficient clearance between the cavity 30 and the rectangular wire terminal 50 is ensured until the press-fit portion 60 is inserted into the cavity 30 thus preventing the rectangular wire terminal 50 from being brought into contact with the cavity 30. Furthermore, a region of contact with the press-fit portion 60 is mainly the first terminal press-fit guiding grooves 38*a*, the region being located in an inner position, and a slide distance of the press-fit portion 60 from a contact start position to a normal insertion position (press-fit completion position) is small. Therefore, even when thread burrs are generated, the amount of the thread burrs is extremely small.

In addition, when the rectangular wire terminal 50 is inserted into the cavity 30, a sufficient clearance can be secured between a part in front of the press-fit portion 60 of the terminal main body 51 (a part to be an electric contact part with another terminal after the press-fit portion 60 is press-fitted) and the side surface of the cavity 30 due to the terminal press-fit guiding groove 38 thus substantially preventing the part in front of the press-fit portion 60 of the terminal main body 51 from being brought into contact with the side surface of the cavity 30. Therefore, it is possible to prevent the quality of the part to be an electric contact part after the press-fit portion 60 is press-fitted from being deteriorated.

The present invention has been explained heretofore in conjunction with the embodiment. The embodiment merely constitutes one embodiment of the present invention. The present invention includes a case of configuring the above-mentioned components as appropriate by combining the components with each other, and various modifications and applications effected by those skilled in the art are conceivable without departing from the gist of the present invention. For example, the projection direction of the press-fit portion 60 is not limited to the lateral direction and may be the vertical direction. The structure of the cavity 30 is determined depending on the projection direction.

According to the present invention, the connector in which the rectangular wire terminal is press-fitted into the cavity of the connector housing can decrease the generation of burrs and ensure the positional accuracy of the rectangular wire terminal press-fitted into the cavity.

What is claimed is:

1. A connector comprising:

a connector housing; and a rectangular wire terminal configured to be press-fitted into and held in a cavity of the connector housing, wherein the rectangular wire terminal includes a press-fit portion that is formed as a projection extending in a direction perpendicular to a terminal insertion direction into the connector housing and is press-fitted into the cavity, a distal surface of the press-fit portion extending parallel to the terminal insertion direction along the whole press-fit portion; and the cavity has guide grooves each of which guides the press-fit portion by a certain length toward a frontward direction from an opening located on a rear side in the terminal insertion direction, wherein the press-fit portion is housed in the guide groove in a press-fitted manner in a state in which the press-fit of the rectangular wire terminal is completed, and wherein the press-fit portion includes a first press-fit portion and a second press-fit portion that are located side by side on a front side and on a rear side, respectively, in the insertion direction, the guide groove includes a first guide groove in which the first press-fit portion is housed and a second guide groove in which the second press-fit portion is housed, in a state in which the press-fit of the rectangular wire terminal is completed, and a width of the first guide groove is smaller than that of the second guide groove, and set substantially equal to a width of the first press-fit portion.

2. The connector according to claim 1, wherein the second press-fit portion is formed in a further projected manner than the first press-fit portion, and the second guide groove is formed more deeply than the first guide groove.

3. The connector according to claim 1, wherein in a region of the rectangular wire terminal in which the press-fit portion is formed, recessed portions of the rectangular wire terminal are formed above and below the press-fit portion, respectively, so that an upper surface and a lower surface of the press-fit portion are exposed.

* * * * *